US005799997A

United States Patent [19]

Lehn et al.

[11] Patent Number: 5,799,997

[45] Date of Patent: Sep. 1, 1998

[54] BUCKET SCOOP

[75] Inventors: John S. Lehn; Aaron S. Best; Eric Schmura, all of Leesport, Pa.

[73] Assignee: Wind-Lock Corporation, Leesport, Pa.

[21] Appl. No.: 785,644

[22] Filed: Jan. 17, 1997

[51] Int. Cl.[6] ..... A47L 17/06

[52] U.S. Cl. ..... 294/55; 15/236.07

[58] Field of Search ..... 294/7, 32, 49, 294/55; 15/105, 236.01, 236.05, 236.07; 30/169, 324, 325, 327

[56] References Cited

U.S. PATENT DOCUMENTS

| | | | |
|---|---|---|---|
| D. 262,686 | 1/1982 | Anderson . | |
| 937,754 | 10/1909 | Bartels . | |
| 1,621,355 | 3/1927 | De Camp | 294/32 |
| 1,756,870 | 4/1930 | May | 294/7 |
| 2,122,767 | 7/1938 | Williams . | |
| 2,283,669 | 5/1942 | Edgren et al. | 294/55 X |
| 2,795,119 | 6/1957 | Bair | 30/325 |
| 4,355,432 | 10/1982 | Storm | 15/236.07 X |
| 4,380,840 | 4/1983 | Rieckenberg | 15/236.07 X |
| 4,627,128 | 12/1986 | Shea . | |
| 4,674,186 | 6/1987 | Galiano | 15/236.07 X |
| 5,033,156 | 7/1991 | Stewart . | |
| 5,182,860 | 2/1993 | Kuhlman | 30/324 X |
| 5,345,642 | 9/1994 | Faldetta | 294/55 X |
| 5,624,145 | 4/1997 | Swilley | 294/55 |

FOREIGN PATENT DOCUMENTS

| | | | |
|---|---|---|---|
| 3333422 | 4/1985 | Germany | 30/327 |
| 438474 | 11/1935 | United Kingdom | 30/327 |

OTHER PUBLICATIONS

Undated Abstract and Sketch, MUD BOSS "Lil Hodie" (2 pages).

*Primary Examiner*—Johnny D. Cherry
*Attorney, Agent, or Firm*—Howson & Howson

[57] ABSTRACT

A scoop for removing semi-fluid materials such as joint compound from a bucket includes a handle for manipulating a receptacle. The receptacle has an open top and an open side face which conforms in shape to the arcuate sidewall of the bucket. Thus, when the receptacle is manipulated into scraping engagement with the bottom of the bucket until it engages the sidewall of the bucket, it can readily scoop up the last remaining quantity of material located within the bucket.

6 Claims, 2 Drawing Sheets

FIG. 3
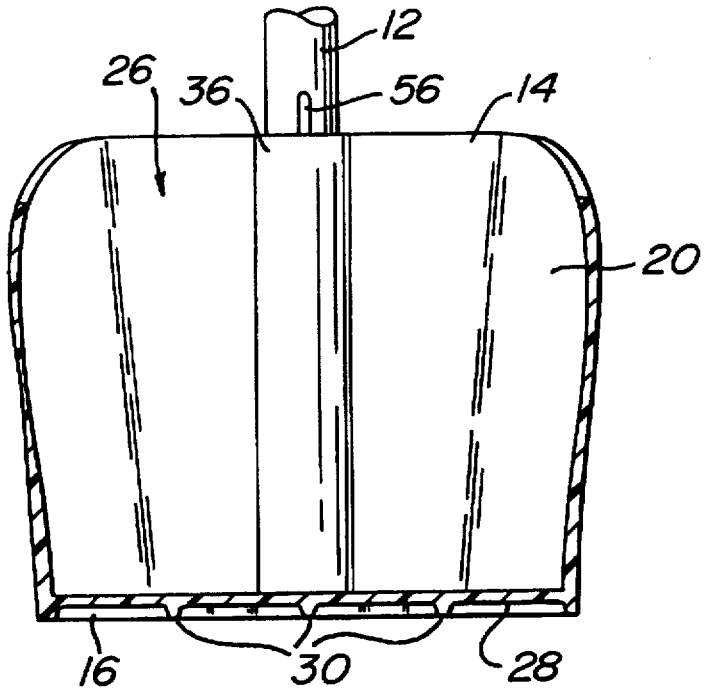
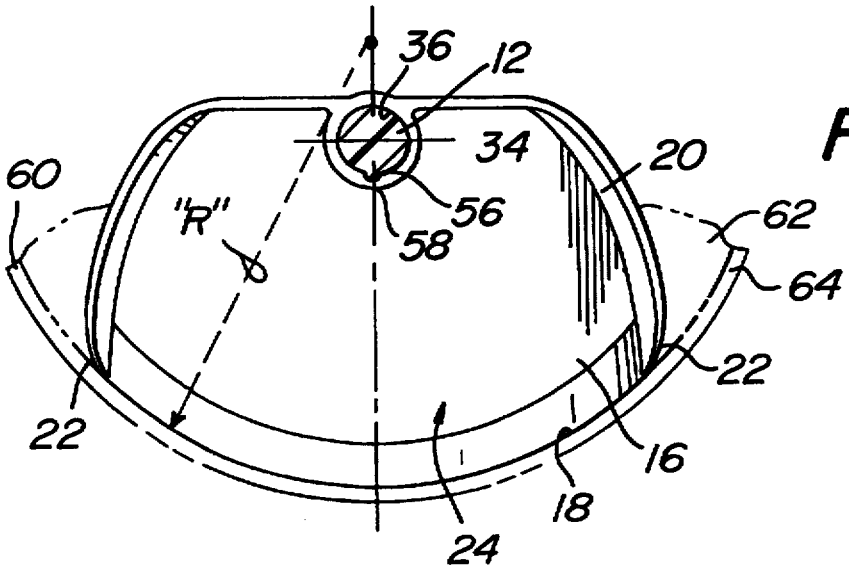
FIG. 4

BUCKET SCOOP

BRIEF SUMMARY OF THE INVENTION

This invention relates to a scoop for removing a semi-fluid material from a bucket-shaped container, and more particularly, to a scoop capable of readily removing the last remaining material, such as joint compound, from the bottom of the bucket-shaped container.

Semi-fluid materials such as joint compound, different types of putties, plaster, and paint are provided in containers such as five gallon drums. These materials are removed from the drums utilizing any number of techniques; however, the removal of the last remaining material from the bottom of the container is generally not readily accomplished without significant effort.

Containers for such material are provided in a large range of sizes, but their shape is basically the same. The containers have a substantially vertical cylindrical sidewall and a flat, horizontal circular base. The upper portion of the sidewall forms an annular rim which defines the opening of the container through which the material is removed. Some of these containers have sidewalls which flare outwardly and upwardly throughout their height.

A conventional trowel is frequently used to remove joint compound from a five gallon drum. The trowel may function satisfactorily when the container is more than about one-third full; however, as the container empties, it becomes much more difficult to remove wanted quantities of the joint compound. The shape of the typical cylindrical container interferes with ready removal of the last remaining quantities of the material.

A worker may need to mix a drum of paint, plaster or putty before removing it from its container. Depending on the age of the material, a significant amount of a component of the material may separate out and collect at the bottom of the container. Conventionally, a stick or other stirring device is used to mix the material in an opened container. However, in some instances, the stick or other stirring device may not adequately stir material located at the bottom of the container and the material dispensed from the container will be either dilute or not homogeneous.

The principal object of this invention is to provide a scoop capable of readily removing the last remaining material from a bucket-shaped container. It is also an object of the invention to provide a scoop which can improve mixing of the contents at the bottom of a bucket-type container. Still another object is to provide a scoop that is inexpensive and easy to use.

The invention addresses the foregoing objects by providing an improved scoop for removing a semi-fluid material from a bucket having an arcuate sidewall. The scoop has a handle with a distal end portion and a proximal end portion. The proximal end portion is adapted to be gripped by a user to manipulate the scoop. A receptacle is attached to the distal end portion of the handle for scooping the semi-fluid material from the bucket receptacle has a base with a peripheral arcuate free edge conforming in shape to the arcuate sidewall of the bucket so that when the arcuate free edge of the receptacle is manipulated into engagement with the arcuate sidewall of the bucket, a given amount of the semi-fluid material is confined within the receptacle for removal from the bucket.

BRIEF DESCRIPTION OF THE DRAWINGS

FIG. 3 is a cross-sectional view of the bucket scoop taken on surface 3—3 of FIG. 1; and FIG. 4 is a cross-sectional view of the bucket scoop taken on surface 4—4 of FIG. 1.

DETAILED DESCRIPTION

Figure 1:
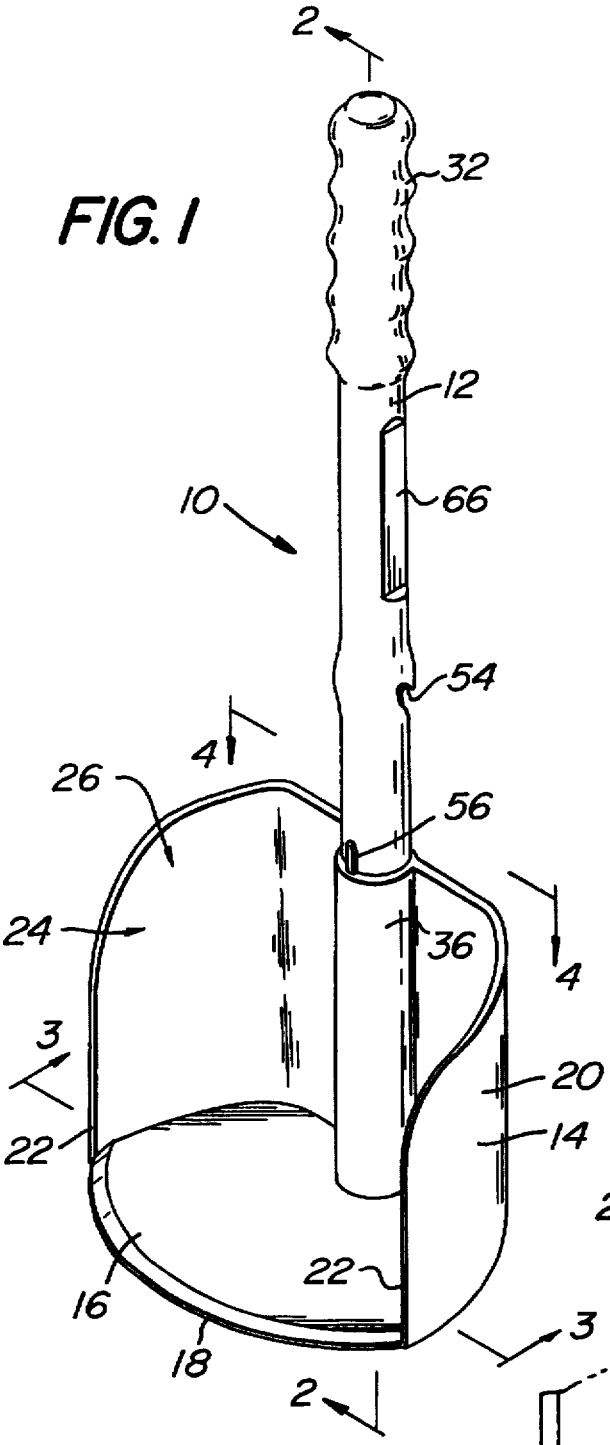
FIG. 1 is a perspective view of a bucket scoop embodying the invention.

FIG. 1 illustrates a scoop 10 for removing a semi-fluid material (not shown) from a bucket-shaped container. The scoop 10 is particularly useful in scooping quantities of joint compound, but can also be utilized to scoop other putties, plaster, paint or like materials.

These types of semi-fluid materials are commonly provided in a container 60, such as a drum, barrel or bucket. Such a container 60 has a flat, circular, horizontal bottom 62 and a substantially cylindrical, vertical sidewall 64. The sidewall 64 of the container forms a rim at the top of the container 60 defining an opening. The containers are available in many different sizes, for example, one gallon and five gallons.

Scoop 10 has a handle 12 and a receptacle 14. The handle 12 is grasped by a user to manipulate the scoop 10. As the scoop is manipulated within the container 60, a portion of the semi-fluid material is collected in the receptacle 14 for removal from the container 60.

Handle 12 and receptacle 14 are preferably injection-molded separately, to reduce manufacturing cost. Each is preferably molded of polypropylene, although other moldable materials can be utilized. After their separate manufacture, the handle 12 and receptacle 14 are connected together to form the scoop 10.

The receptacle 14 is molded with a base 16 having an arcuate free edge 18. A sidewall structure 20 extends upward from the periphery of the base 16 except from the arcuate free edge 18. The sidewall 20 has vertical edges 22 which terminate adjacent to ends of the arcuate free edge 18, thus, an open side face 24 is provided. The receptacle 14 is also provided with an open top 26.

The arcuate free edge 18 of the base 16 of the receptacle 14 is specifically designed so that it is capable of being placed close to the arcuate sidewall 64 of the container 60 of the semi-fluid material to engage the arcuate sidewall 64. For instance, a scoop 10 designed for use with a five gallon bucket would have an arcuate free edge 18 with about the same radius of curvature "R" as that of the arcuate sidewall 64 of the five gallon bucket adjacent the base 62 of the bucket 60. Thus, when the arcuate free edge 18 abuts the arcuate sidewall 64 of the bucket 60, the edges 22 of the sidewall 20 of the receptacle 14 also substantially abut the sidewall 64 of the bucket 60 so that a quantity of the semi-fluid material is confined by the base 16, by the co-operating sidewall 20, and the sidewall 64 of the bucket 60. To remove the confined material, the receptacle 14 is tilted backward to minimize the amount of semi-fluid material that flows back into the bucket 60 as the scoop 10 is lifted from the bucket 60.

The preferred embodiment of the receptacle 14 of the Scoop 10 is shown in the drawings. The base 16 is flat to conform in shape to the flat shape of the bottom wall 62 of the container 60 of the semi-fluid material. The arcuate free edge 18 is bevelled to ensure that the last remaining quantity of semi-fluid material can be lifted from the bottom wall 62 of the container 60 of the semi-fluid material and forced up and into the scoop 10. To this end, the bevel is located on top of the base 16 so that the free edge 18 can be as close as possible to the floor 62 of the bucket 60. The underside 28 of the base 16 is rigidified by a plurality of reinforcing ribs 30. This enables the receptacle 14 to be made from a minimum of material, thereby reducing the material costs in manufacturing the scoop 10. The reinforcement ribs 30 are rounded, as shown in FIG. 3, so that the semi-fluid material does not readily collect on the underside 28 of the base 16 of the scoop 10.

Figure 2:
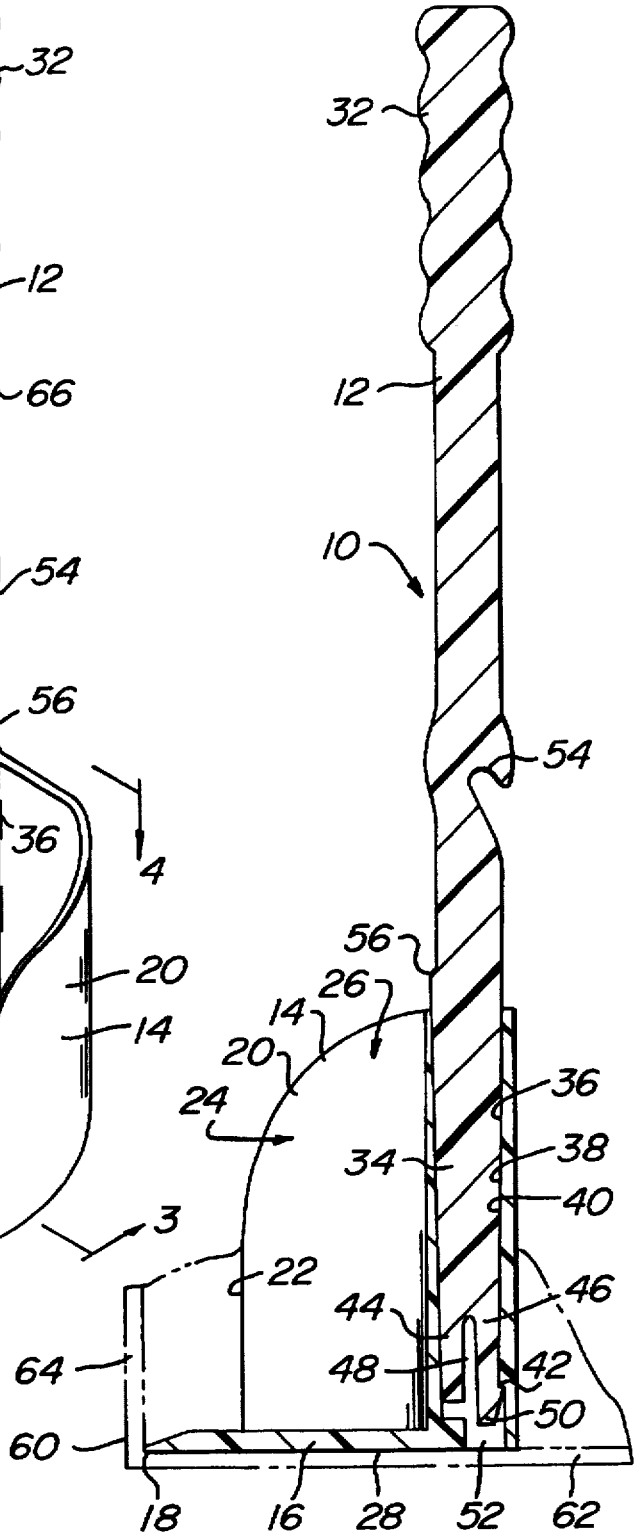
FIG. 2 is a cross-sectional view of the bucket scoop taken on surface 2—2 of FIG. 1.

The handle 12 has a proximal end 32 which is adapted to be grasped by a user and a distal end 34 which connects to the receptacle 14. As shown in FIG. 2, the handle 12 fits within a hollow tube 36 formed in the sidewall 20 of the receptacle 14 opposite the arcuate free edge 18.

The preferred embodiment of the scoop 10 as illustrated utilizes a snap-fit type of engagement between the handle 12 and the receptacle 14. As shown in FIG. 2, the tube 36 has an inner wall 38 which has a tapered portion 40 tapering inwardly from top to bottom. The inner wall 38 also has an outwardly extending ledge 42 formed at the bottom of the tapered portion 40. The distal end 34 of the handle 12 is correspondingly tapered and has two resilient prongs, 44 and 46, which, when in their normal positions, are separated by a slot 48. Prong 46 has an outwardly projecting flange 50 which is co-operatively engageable with the ledge 42 of the inner wall 38 to lock the handle 12 to the receptacle 14.

The handle 12 is connected to the receptacle 14 by extending the distal end 34 of the handle 12 into the tube 36. The flange 50 of prong 46 forces prong 46 toward prong 44 under the pressure exerted by the tapered portion 40 of the inner wall 38. When the distal end 34 is fully extended into the tube 36, the prong 46 resiliently snaps back into its normal position and into locking engagement with the ledge 42.

The handle 12 is formed with a guide rib 56 which mates with a vertical indentation 58 formed in the inner wall 38 of the tubular slot 36. Therefore, the distal end 34 of the handle 12 is only received within the tubular slot 36 of the receptacle 14 when the guide rib 56 and indentation 58 are aligned. This ensures proper positioning of the flange 50 relative to the ledge 42.

As shown in FIG. 2, the base 16 of the receptacle 14 is provided with an aperture 52 directly below the tube 36. Although not shown in the drawings, the flange 50 of the prong 46 can be provided with a plug-like extension to close the aperture 52 to prevent the semi-fluid material from collecting inside the tube 36 of the receptacle 14.

Another advantage of the invention is that when the scoop 10 is not in use, the scoop 10 can be supported from the rim of the container 60 of the semi-fluid material. To this end, the handle 12 has a notch 54 formed in a widened portion of the handle between the proximal and distal ends, 32 and 24. The notch 54 is angled upwardly so that when the notch 54 is in engagement with the rim of the container 60 of the semi-fluid material, it supports the scoop 10 therefrom.

The notch 54 is located on the handle 12 in a manner to ensure that when the scoop 10 is hung from a bucket 60, the arcuate free edge 18 of the receptacle 14 is remote from the sidewall 64 of the bucket 60. The guide rib 56 and vertical indentation 50 ensure proper positioning of the notch 54 relative to the receptacle 14 so that the notch 54 opens in a direction opposite and away from the arcuate free edge 18 of the receptacle 14.

The location of the notch 54 on the handle 12 also ensures that the base 16 of the scoop 10 is positioned above the bottom wall 62 of the container 60. Thus, the scoop 10 can be hung from the rim either inside or outside the container 60.

The handle 12 also has at least one flat 66 for placement of a label (not shown). The flat 66 is particularly designed to receive hot-stamped or peel-on labels.

A scoop 10 having the above described features can be utilized, for example, to remove joint compound from a five gallon bucket 60. When the bucket 60 is essentially full, the scoop 10 can by utilized in the same manner as any standard trowel, shovel or ladle-type device. However, as the bucket 60 is emptied, removal of joint compound with the standard devices becomes more difficult because they cannot properly fit into the corner formed where the sidewall 64 and bottom 62 of a bucket 60 meet.

In summary, the base 16 of the scoop 10 matches the sidewall 64 of the bucket 60 because the arcuate free edge 18 has about the same radius of curvature as the arcuate sidewall 64 of the bucket 60. The arcuate free edge 18 is bevelled so that when the scoop 10 is scraped along the bottom wall 62 of the bucket 60, a quantity of the semi-fluid material is lifted into the scoop 10, even material that is located in an area where the bottom wall 62 of the bucket 60 meets the sidewall 64. In addition, when the arcuate free edge 18 of the scoop 10 abuts the sidewall 64 of the bucket 60, the semi-fluid material is confined on the base 16 of the scoop 10 by the sidewall 64 of the bucket 60 and the sidewall 20 of the receptacle 14. Thus, the scoop 10 provides a ready means of removing quantities of semi-fluid material even when the bucket 60 is practically empty.

Another example of a use of the scoop 10 according to the invention is the mixing of semi-fluid material such as paint, plaster or putty within an opened container or bucket. The scoop 10 is extended into the bucket 60, so that the base 16 of the scoop 10 is located on the bottom wall 62 of the bucket 60. The scoop 10 is then rotated within the bucket 60 with the base 16 of the scoop traveling around the periphery of the bottom wall 62 of the bucket 60 to ensure mixture of components located along the bottom wall 62 of the bucket 60.

Various modifications can be made to the scoop described above without departing from the scope of the invention as defined in the following claims.

We claim:

1. A scoop for removing a semi-fluid material such as joint compound from a bucket-shaped container having an open top, an upper peripheral rim, a substantially cylindrical sidewall and a substantially flat bottom wall, said cylindrical sidewall having a pre-determined radius of curvature, the scoop comprising:

a substantially flat base with a peripheral edge, said peripheral edge including an arcuate bevelled free edge conforming in shape to the cylindrical sidewall of the container such that said arcuate free edge has a radius of curvature substantially the same as the predetermined radius of curvature of the cylindrical sidewall of the bucket-shaped container;

a sidewall extending from a portion of said peripheral edge of said base such that the scoop is open directly above said arcuate free edge; and a separately formed handle having a distal end portion capable of lockingly engaging to said scoop sidewall at a location remote from said arcuate bevelled free edge, said handle having a proximal end portion adapted to be grasped by a user to manipulate the scoop;

whereby when the scoop is positioned in the container and said arcuate bevelled free edge of the scoop is manipulated along the bottom wall until it abuts the cylindrical sidewall of the container, a given amount of the semi-fluid material is confined within said base and sidewall of the scoop and the cylindrical sidewall of the container for ready removal from the container.

2. A scoop according to claim 1, wherein said scoop sidewall has a hollow tube for receiving said distal end of said handle.

3. A scoop according to claim 2, wherein said hollow tube has an inner wall which tapers inwardly from top to bottom; and wherein said distal end of said handle has at least one prong with an outwardly projecting locking flange.

4. A scoop according to claim 3, wherein said inner wall of said hollow tube has a ledge for receiving said locking flange in locking engagement.

5. A scoop according to claim 4, wherein said distal end of said handle has a guide rib and said inner wall of said hollow tube has an indentation formed therein, and wherein said guide rib and said indentation prevent said distal end of said handle from being received in said hollow tube unless said guide rib and said indentation are aligned.

6. A scoop according to claim 1, wherein said sidewall of the scoop extends upward from said base; wherein said sidewall has two edges extending substantially perpendicular to said base and upwardly from the ends of said arcuate bevelled free edge of said base; whereby, when said arcuate bevelled free edge is in contact with the cylindrical sidewall of the container, said base, said sidewall of the scoop and the cylindrical sidewall of the container define a space in which a semi-fluid material can be confined.

* * * * *